United States Patent [19]

Speich

[11] Patent Number: 5,052,447

[45] Date of Patent: Oct. 1, 1991

[54] GUIDE DEVICE FOR A WEB OF MATERIAL AT THE LOOM CLOTH FELL

[75] Inventor: Francisco Speich, Gipf-Oberfrick, Fed. Rep. of Germany

[73] Assignee: Textilma AG

[21] Appl. No.: 455,444

[22] PCT Filed: Mar. 17, 1989

[86] PCT No.: PCT/CH89/00053

§ 371 Date: Nov. 17, 1989

§ 102(e) Date: Nov. 17, 1989

[87] PCT Pub. No.: WO89/08734

PCT Pub. Date: Sep. 21, 1989

[30] Foreign Application Priority Data

Mar. 18, 1988 [CH] Switzerland ..... 1056/88

[51] Int. Cl.[5] ..... D03J 1/22

[52] U.S. Cl. ..... 139/291 R; 139/188 R; 139/295; 139/294

[58] Field of Search ..... 242/76; 226/168; 139/291 R, 292, 293, 294, 295, 296, 297, 298, 299, 300, 301, 304, 307, 308, 311, 188 R; 26/92, 97, 99, 102, 106

[56] References Cited

U.S. PATENT DOCUMENTS

| | | | |
|---|---|---|---|
| 2,983,288 | 5/1961 | Metzler | 139/291 R |
| 3,426,807 | 2/1969 | Pfarrwaller | 139/294 |
| 3,446,250 | 5/1969 | Pfarrwaller | 139/294 |
| 3,961,651 | 6/1976 | Balentine, Jr. | 26/92 X |
| 4,383,633 | 5/1983 | Seragnoli | 242/76 |

FOREIGN PATENT DOCUMENTS

| | | | |
|---|---|---|---|
| 495300 | 5/1928 | Fed. Rep. of Germany | 139/291 |
| 332149 | 4/1972 | U.S.S.R. | 139/297 |

*Primary Examiner*—Andrew M. Falik

*Attorney, Agent, or Firm*—Toren, McGeady & Associates

[57] ABSTRACT

A guide device for a web of material at a point of a textile machine, preferably a weaving machine, at which the web of material is produced. The guide device includes a first guide strip with a guide edge which first guide strip is arranged subsequent to the point at which the web of material is produced and a second guide strip with a guide edge which second guide strip is arranged subsequent to the first guide strip. The guide strips extend in each instance along the entire width of the web of material and overlap one another in such a way the web of material is guided at least approximately in an F-shaped manner. The guide edge of the second guide strip is formed by a rotatable round bar. The rotatable round bar is arranged in a loose manner in such a way that is is supported, under the influence of the tensile stress of the web of material, along the web of material at the first guide edge and in direct contact at the end face of a guide element of the second guide strips.

17 Claims, 2 Drawing Sheets

GUIDE DEVICE FOR A WEB OF MATERIAL AT THE LOOM CLOTH FELL

BACKGROUND OF THE INVENTION

1. Field of the Invention

The invention is directed to a guide device or a web of material at a point of a textile machine, preferably a weaving machine, at which the web of the material is produced. The guide device includes a first guide strip with a guide edge which first guide strip is arranged subsequent to the point at which the web of material is produced, and a second guide strip with a guide edge which second guide strip is arranged subsequent to the first guide strip. The guide strips extend in each instance along the entire width of the web of material and overlap one another in such a way that the web of material is guided at least approximately in an d-s shaped manner.

2. Description of the Related Art

In addition, guide devices are known from AT-PS 275 437 and CH-PS 562 358 (corresponds to US-PS 3 961 650) which are constructed as clamping bar spreaders. They comprise an approximately cylindrical recess, as guide element, which contains a slot with an inlet and outlet edge. A clamping bar is arranged in the recess and is provided with a right-hand thread on one half and a left-hand thread on the other half. The web of material is guided around this clamping bar. The web of material leaving the clamping bar spreader is drawn off by means of a driven material take-off roller, so that a force is exerted on the clamping bar in the recess which tightens and presses the clamping bar against the slot of the recess, so that further movement of the web of material is prevented. The woven web of material is first displaced by means of beating up a filling thread at the set-up edge and accordingly relieves the clamping bar on one side, so that the web of material can be drawn again by means of the material take-off roller. The web of material is tensioned at the clamping bar in the direction of the sides, i.e. in width, as a result of the opposite thread, so that a contraction in the width of the woven material is prevented for the time being. This guide device, which is constructed as a clamping bar spreader, acts in practice like a locking mechanism which allows the web of material to run through in only one direction and blocks it in the other direction. However, there is the disadvantage that the web of material is subjected to an intense stress by means of the clamping action of the clamping bar in the recess, which has a disadvantageous effect on the quality of the web of material. In addition, the filling thread must be beaten up with considerable force in order to bring the web of material into the recess via the inlet edge accompanied by the disengagement of the clamping bar. Moreover, the device is very susceptible to dust, since the dust in the interior of the recess can not be removed practically and has a disadvantageous effect on the clamping action of the clamping bar. Moreover, access to the clamping bar is difficult. In addition, the adjustment of the clamping bar spreader is difficult.

SUMMARY OF THE INVENTION

It is the object of the present invention to construct a guide device of the type named in the beginning in such a way that, on the one hand, a good guidance is imparted to the web of material at the point at which the web of material is produced and, on the other hand, this guide device is easily accessible, enables the web of material to run through in both directions and can be adjusted in a simple manner to the type of material and its production.

The object is met, in accordance with the present invention, by forming the guide edge of the second guide strip by means of a rotatable round bar.

Since the guide edge of the second guide device is formed by means of a rotatable round bar, the resistance put up by the second guide strip against the running of the web of material is smaller and can be adapted to the web of material in a particularly simpler and subtler manner e.g. by varying the warp thread tension. In addition, this guide device is easily accessible in a known manner, so that it is easier to handle on the one hand and simpler to service on the other hand. Thus, this guide device can be adjusted in a simpler manner and occurring dust can be removed, i.e. sucked out, without difficulty.

The terms web of material and textile machinery are employed here in the widest sense and include webs of material of the most varied type, such as tufted webs of material, knitted webs of material and particularly woven webs of The round bar can be guided at the arms of a guide strip which can be constructed in a hook-shaped manner or a fork-like manner. However, in accordance with another feature, the round bar is arranged in a loose manner in such a way that it is supported, under the influence of the tensile stress of the web of material, along the web of material at the first guide edge, on the one hand, and at the end face of the guide element of the second guide strip, on the other hand. This construction is more advantageous, since the clamping according to claim 2 is more advantageous, since the clamping action exerted on the web of material by the round bar at the first guide edge can be adjusted in a very subtle manner particularly by means of the influence of the tensile stress of the web of material. For this purpose, it is advantageous if the guide device is constructed such that the web of material is guided at the outlet side of the round bar at an acute angle toward the plane through the web of material after the point at which the web of material is produced; then the pressing of the round bar against the first guide edge is.

The guide device can also be adjusted more subtly to the type of web of material and/or its method of production.

A particularly advantageous construction of the guide device is provided if the first guide edge and/or the round bar are/is provided with oppositely inclined guide notches at both sides of the center plane in such a way that the web of material is tensioned in an outward direction at both sides of the center plane since the guide device acts as a spreader on the one hand and the alignment of the web of material in the running direction is improved on the other hand.

In addition, it is advantageous if the round bar is heatable so as to enable a reduction of internal stresses of the woven material and accordingly an improvement in the shrinkage behavior of the woven material. For this purpose, the round bar is provided with an electric heating bar. But a construction is preferred in which the round bar is located at an end face of a guide element which comprises a heat conducting material and is connected with a heating element at the guide strips. In another development, the guide element is provided with a plate facing the web of material and directed in the running direction of the latter and is connected with the heating element on the side remote of the webs of material, the heat treatment by means of the plate is also continued along a partial area after the round bar. In addition it can be advantageous also to provide the stabilizing bar with a heating device Embodiment examples of the guide device according to the invention are described in more detail in the following by means of a drawing:

DESCRIPTION OF THE PREFERRED EMBODIMENTS

Figure 1:
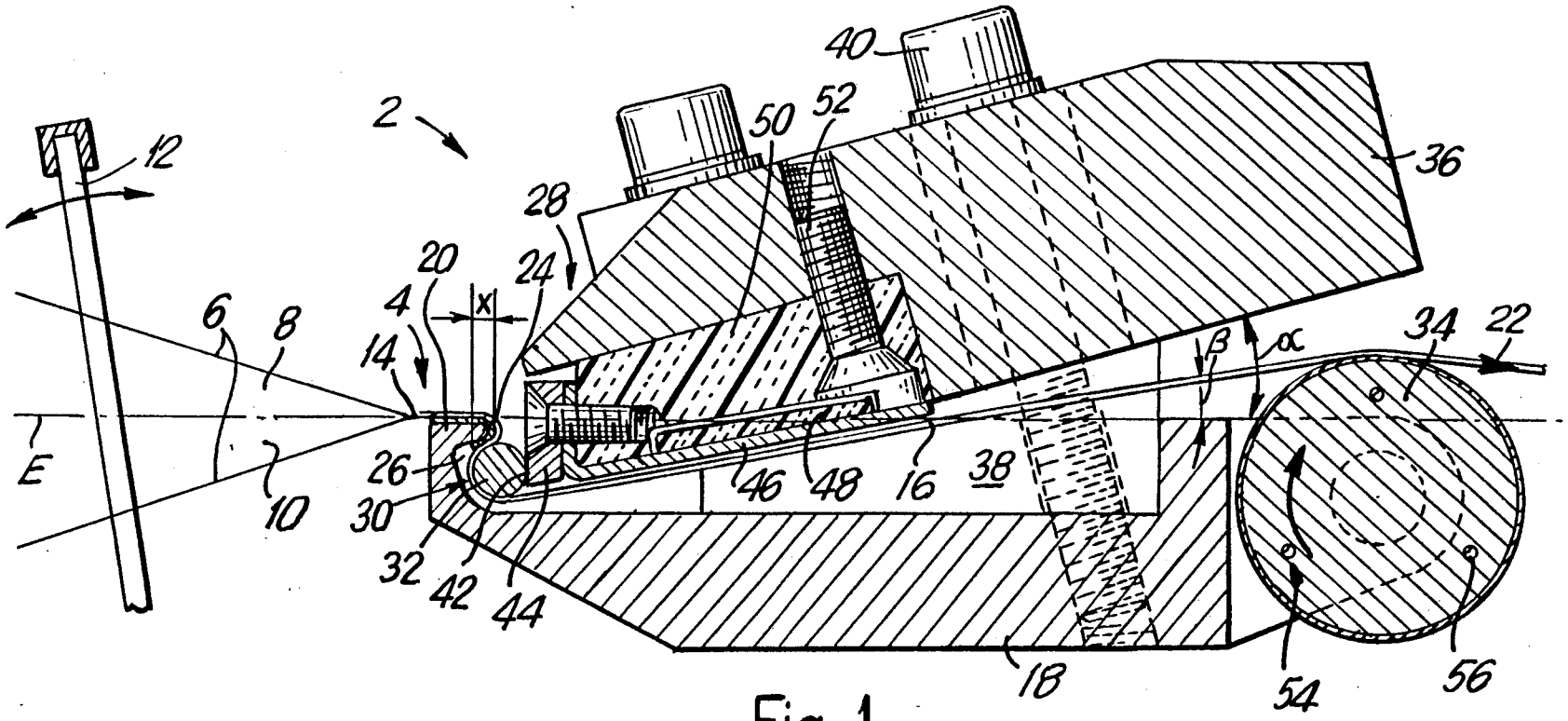
FIG. 1 shows a guide device in the vertical section along the center plane of the web of material.

FIG. 1 shows a guide device 2 at a point at which the web of material is produced, i.e. the weaving location 4 of a well-known weaving machine, not shown in more detail. FIG. 1 shows the warp threads 6 which are guided by means of a shedding device, not shown, in such a way that an open shed 8 is formed through which a filling thread 10 is picked and beaten up by means of a weaving reed 12 at a set-up edge 14 of the woven web of material 16. The web of material 16 is drawn off on the right-hand side of the guide device 2 by means of a material take-off roller, not shown in more detail.

The guide device 2 contains a carrier 18 which carries a guide strip 20 at its side facing the weaving location 4, the web 16 of material lying on the surface of the guide strip 20. This first guide strip comprises a guide edge 22 facing in the running direction 22 of the web 16 of material, the latter being guided via the guide edge 22 into a groove-like recess 26 located under it. For this purpose, a second guide strip 28 comprising a guide edge 30 is used which introduces the web 16 of material into the recess 26 so that the web of material is guided at least approximately in an S-shaped manner. After the second guide edge 30, which is constructed as a round bar 32, the web 16 of material runs further to the aforementioned material take-off roller, not shown, along a stabilizing bar 34 which is arranged at the carrier 18 so as to be rotatable.

The second guide strip 28 contains a beam 36 which extends parallel to the carrier 18 and is guided at diagonal guides 38 of the carrier 18 in such a way that it can be fed toward the groove-like recess 26 and can be locked by means of a locking screw 40. In this way, the second guide strip 28 is guided in an inclined manner at an acute angle a toward the plane E through the web 16 of material after the point at which the web 16 of material is produced, i.e. the weaving location 4. The overlapping depth X of the guide edge 30 and of the round bar 32 with respect to the first guide strip 20 with the guide edge 24 is adjustable by means of the displaceability of the second guide strip 28.

The round bar 32 is arranged in a loose manner in such a way that it is supported, under the influence of the tensile stress of the web 16 of material, along the web 16 of material at the guide edge 24 of the first guide strip 20 on the one hand and, on the other hand, at an end face 42 of a guide element 44 of the second guide strip 28. The support of the round bar 32 is reinforced in that the stabilizing bar 34, which is preferably driven in the running direction 22 of the web 16 of material, guides the latter at an acute angle $\beta$ relative to the plane E of the web of material. Depending on the magnitude of the tensile stress of the web of material, the round bar 32 is pressed with more or less force against the first guide edge 24 and the end face 42. A clamping of the web of material between the round bar 32 and the first guide edge 24 results in particular from the pressing against the first guide edge 24.

Figure 5:
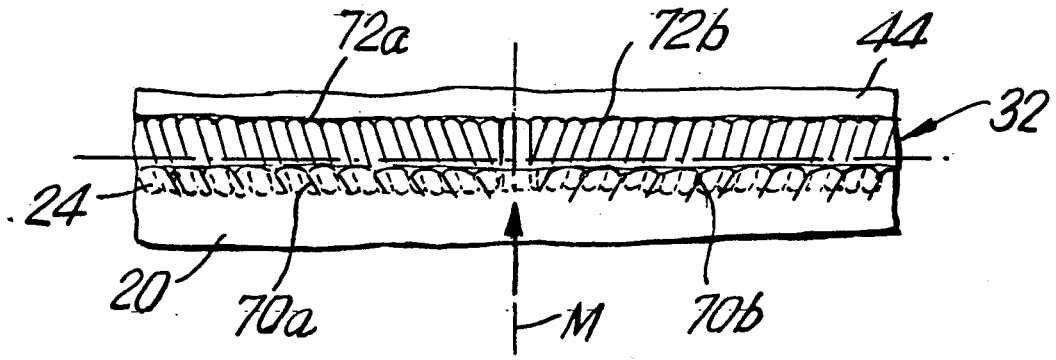
FIG. 5 shows in a top view and in section the guide strip and the round bar with guide notches.
Figure 6:
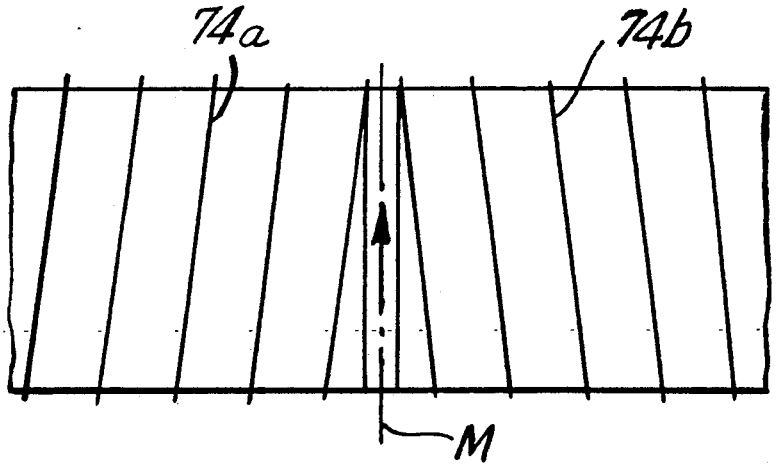
FIG. 6 shows in a top view the stabilizing bar with threads.

As shown in FIG. 5, the first guide edge 24 is provided with oppositely inclined guide notches 70*a*, 70*b* at both sides of the center plane m in such a way that the web of material is tensioned in an outward direction at both sides of the center plane. The guide notches 72*a*, 72*b*; which are shown in FIG. 5, are formed in the round bar 32 by means of a right-hand or left-hand thread. As shown in FIG. 6, the stabilizing bar 34 is also provided with threads 74*a*, 74*b*; running in opposite directions at both sides of the center plane in such a way that the web of material is tensioned in an outward direction at both sides of the center plane.

The round bar 32 is heatable. For this purpose, the guide element 44 comprises heat conducting material and is connected with a heating element 48 arranged in an insulating body 50, which is fastened in the beam 36 by means of screws 52, via a plate 46, which is likewise heat conducting. The heat is transmitted from the heating element 48 to the guide element 44 via the plate 46 and to the round bar via the end face 42. The plate 46 extends beyond this in the running direction 22 along the web 16 of material, so that a heat treatment, and accordingly a thermal fixing of the spread web of material, is also effected after the round bar by means of the plate 46.

The stabilizing bar 34 can also contribute to the thermal fixing of the web of material and is provided for this purpose with a heating device 34 consisting of heating elements 56.

Figure 3:
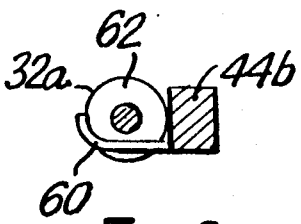
FIG. 3 shows a third type of guidance of the round bar in section and in cross section.
Figure 2:
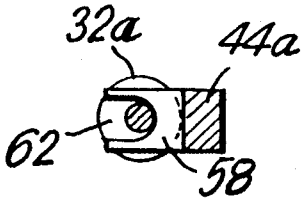
FIG. 2 shows a second type of guidance of the round bar in section and in cross section.

Instead of the free arrangement of the round bar 32 according to the embodiment example of FIG. 1, the guide element 44*a* can also be provided with arms which are distributed along the length of the round bar and can be constructed, e.g. according to FIG. 2, as fork-like arms 58 or, according to FIG. 3, as hook-like arms 60. These arms 58, 60 engage in circumferentially extending grooves 62 of the round bars 32*a* the arms 58, 60 are distributed over the length of the second guide strip 28. Despite the guidance at the arms 58, 60, the play can be dimensioned large enough so that a desired clamping between the round bar 32*a* and the first guide edge 24 is achievable by means of the tension of the web of material.

Figure 4:
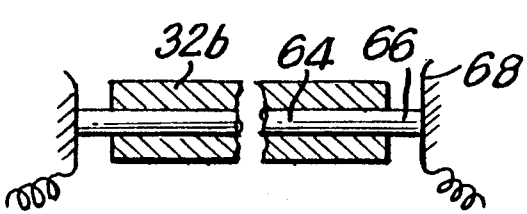
FIG. 4 shows another embodiment form for heating the round bar in longitudinal section through the round bar.

Instead of the indirect heating of the round bar 32 shown in FIG. 1, the latter can also be directly provided with a heating bar 64 which is arranged e.g. coaxially, according to the embodiment example of FIG. 4. Contact pins 66 of the heating bar 64 which project forward at both ends of the round bar 32*b* cooperate with corresponding contact elements 68 at the guide device 2, so that an electrical contact is ensured even during a displacement of the round bar **32*b*** transversely relative to its axis.

We claim:

1. Guide device for a web of material at a point of a weaving machine, at which the web of material is produced, the guide device comprising a first strip (20) with a guide edge (24), which first guide strip (20) is arranged subsequent to the point (4) at which the web of material is produced, and comprising a second guide strip (28) with a guide edge (30), which second guide strip (28) is arranged subsequent to the first guide strip (20), wherein the guide strips (20, 28) extend in each instance along the entire width of the web (16) of material and overlap one another in such a way that the web (14) of material is guided at least approximately in an S-shaped manner, wherein the guide edge (30) of the second guide strip (28) is formed by means of a rotatable round bar (**32, 32*b*) and wherein the round bar (32, 32*a*, 32*b*) is arranged in a loose manner in such a way that it is supported, under the influence of the tensile stress of the web (16) of material, along the web (16) of material at the first guide edge (24) and in direct contact at the end face (42) of a guide element of the second guide strip 28**.

2. Guide device according to claim 1, wherein arms (58, 60) are arranged at the second guide strip (28) so as to be distributed along the length of the latter, which arms (58, 60) engage in circumferentially extending grooves (62) at the round bar (**32*a***).

3. Guide device according to claim 2, wherein the arms (60) are constructed in a hook-shaped manner.

4. Guide device according to claim 2, wherein the arms (58) are constructed in a fork-like manner.

5. Guide device according to claim 1, wherein the web (16) of material is guided at an outlet side of the round bar (**32, 32*a*, 32*b*) at an acute angle ($\beta$) toward a plane (E) through the web (16) of material after the point (4) at which the web (16**) of material is produced.

6. Guide device according to claim 1, wherein the web (16) of material is guided along a stabilizing bar (34) after the round bar (**32, 32*a*, 32*b*), which stabilizing bar (34**) is drivable.

7. Guide device according to claim 6, wherein the stabilizing bar (34) is drivable in the running direction (22) of the web (16) of material, wherein the drive speed is greater than the running speed of the web (16) of material.

8. Guide device according to claim 7, wherein the stabilizing bar (34) is provided with opposite threads at both sides of a center plane in such a way that the web (16) of material is tensioned in an outward direction at both sides of the center plane.

9. Guide device according to claim 6, wherein the stabilizing bar (34) is provided with a heating device (54).

10. Guide device according to claim 1, wherein the guide strips are arranged to provide an adjustable overlapping depth.

11. Guide device according to claim 9, wherein the second guide strip (28) is arranged so as to be adjustable at a diagonal guide (38) whose inclination forms an acute angle (a) with the plane (E) through the web (16) of material after the point (4) at which the web (16) of material is produced.

12. Guide device according to claim 1, wherein one of the first guide edge (24) or the round bar (**32, 32*a*, 32*b*) is provided with oppositely inclined guide notches at both sides of a center plane in such a way that the web (16**) of material is tensioned in an outward direction at both sides of the center plane.

13. Guide device according to claim 1, wherein the round bar (**32, 32*a*, 32*b***) is heatable.

14. Guide device according to claim 13, wherein the round bar (**32*b*) is provided with an electric heating bar 64**.

15. Guide device according to claim 13, wherein the round bar (32) is located at an end face (42) of a guide element (44) which comprises a heat conducting material and is connected with a heating element (48) at the guide strip (28).

16. Guide device according to claim 15, wherein the guide element 44 is provided with a plate (46) facing the web (16) of material and directed in the running direction of the latter and is connected with the heating element (48) on the side remote of the web (16) of material.

17. Guide device according to claim 1, wherein the first guide edge (24) and the round bar (**32, 32*a*, 32*b*) are provided with oppositely inclined guide notches at both sides of a center plane in such a way that the web (16**) of material is tensioned in an outward direction at both edges of the center plane.

* * * * *

UNITED STATES PATENT AND TRADEMARK OFFICE

CERTIFICATE OF CORRECTION

PATENT NO. : 5,052,447
DATED : October 1, 1991
INVENTOR(S) : Francisco Speich

It is certified that error appears in the above-indentified patent and that said Letters Patent is hereby corrected as shown below:

On the Title page, items [75] and [73] should read as follows:

[75] Inventor: Francisco Speich,
Gipf-Oberfrick, Switzerland

[73] Assignee: Textilma AG
CH-6052 Hergiswil, Switzerland

Signed and Sealed this
Seventh Day of June, 1994

Bruce Lehman

BRUCE LEHMAN
*Commissioner of Patents and Trademarks*

*Attest:*

*Attesting Officer*